United States Patent [19]

Ramsey et al.

[11] Patent Number: 4,712,704

[45] Date of Patent: Dec. 15, 1987

[54] SELF-SEALING CLOSURE

[76] Inventors: Douglas P. Ramsey, 154 Fiesta Rd., Rochester, N.Y. 14626; Michael J. O'Brien, 106 Meadow Farm N., North Chili, N.Y. 14514

[21] Appl. No.: 16,345

[22] Filed: Feb. 19, 1987

[51] Int. Cl.[4] ..... B65D 51/18; A47G 19/22

[52] U.S. Cl. ..... 220/254; 220/90.4; 220/336; 222/506; 222/518

[58] Field of Search ..... 220/90.4, 254, 259, 220/336, 90.2, 90.6; 222/506, 518

[56] References Cited

U.S. PATENT DOCUMENTS 4,171,060 10/1979 Howard et al. ..... 220/254

4,190,173 2/1980 Mason et al. ..... 220/254

4,276,992 7/1981 Susich ..... 220/254

4,303,173 12/1981 Nergard ..... 220/90.4

4,561,563 12/1985 Woods ..... 220/336

*Primary Examiner*—George T. Hall

*Attorney, Agent, or Firm*—Howard J. Greenwald

[57] ABSTRACT

A self-sealing closure for drinking vessels is disclosed. This closure is comprised of (1) a detachable lid, which can be used to cover the receptacle of the drinking vessel, and which has a depressed area and at least one orifice within the depressed area; (2) a shutter matching said orifice; (3) means for resiliently holding the shutter against the orifice; and (4) rotatable means for pushing the shutter away from the orifice.

16 Claims, 16 Drawing Figures

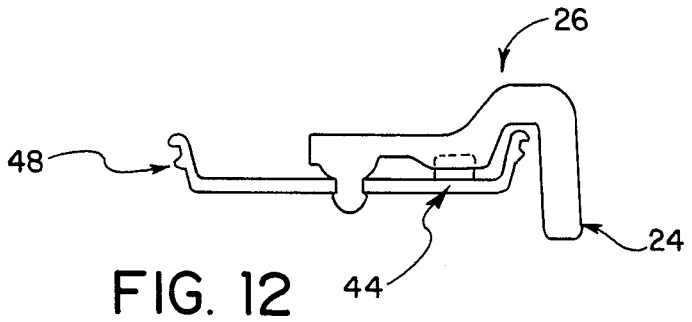
FIG. 12
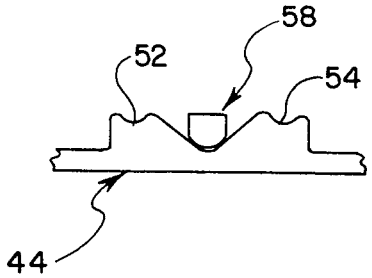
FIG. 13
FIG. 15
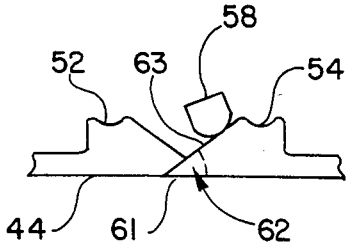
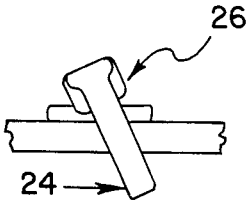
FIG. 14
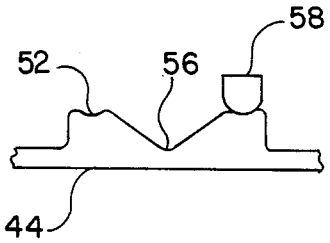
FIG. 16

SELF-SEALING CLOSURE

BACKGROUND OF THE INVENTION

The present invention relates generally to a closure for drinking vessels and, more particularly, to a closure which is self-sealing. The closure of this invention may be opened by thumb pressure in order to remove liquid from the drinking vessel. However, once the thumb pressure is released, the closure automatically returns to its closed position.

Many closures for drinking vessels have been provided by the prior art. Frequently these vessels are used by one who is also engaged in other tasks such as, e.g., driving, riding in a vehicle, or working at a place of employment.

There is a need for a spill-proof drinking vessel which can be easily used by a consumer of liquid. Preferably, such a consumer should be able to open such vessel with only one hand and with the exertion of only a minimal amount of pressure; and, in order to insure that liquid does not spill from the vessel once the consumer has finished drinking from it, the vessel should close automatically once the consumer has put it down.

Many of the drinking receptacles currently used by the public are relatively inexpensive. The closure for the drinking vessel also should be relatively inexpensive.

One of the closures for drinking vessels provided by the prior art is described in U.S. Pat. No. 4,171,060. Although the closure of this patent can be opened with a minimal amount of thumb pressure, it does not appear that the closure automatically returns to its closed positon when the thumb pressure is released.

It is an object of this invention to provide a closure for drinking vessels which is relatively inexpensive to produce, which can be operated with only one hand, which can be opened with the application of only a minimal amount of pressure, and which closes automatically when the pressure is released.

SUMMARY OF THE INVENTION

In accordance with this invention, there is provided a self-sealing closure for drinking receptacles, comprised of (1) a detachable lid covering the receptacle and having a depressed top area and at least one orifice within the depressed top area, (2) a shutter matching said orifice; (3) means for resiliently holding the shutter against said orifice; and (4) means rotating within a plane perpendicular to the cental axis of said receptacle and lid for pushing the shutter away from said orifice in a direction substantially orthogonal to the plane of said orifice.

BRIEF DESCRIPTION OF THE DRAWINGS

The present invention will be more fully understood by reference to the following detailed description thereof, when read in conjunction with the attached drawings, wherein like reference numerals refer to like elements and wherein:

FIG. 12 is a cross-sectional view taken along lines B—B of FIG. 10.

FIGS. 13, 14, 15, and 16 illustrate the ramp construction utilized in the embodiment of FIGS. 10, 11, and 12.

DESCRIPTION OF THE PREFERRED EMBODIMENTS

The closure device of this invention is usually used with a vessel for drinking or for holding and pouring powdered and liquid substances which is generally comprised of a cup-shaped receptacle. The closure device is preferably comprised of (1) a detachable lid covering the receptacle having a depressed top area and at least one orifice within the depressed top area; (2) a shutter matching said orifice; (3) means for resiliently holding the shutter against said orifice; and (4) means rotating within a plane perpendicular to the central axis of said receptacle and lid for pushing the shutter away from said orifice in a direction substantially orthogonal to the plane of said orifice.

The closure device of this invention has a unique, advantageous combination of properties which, to the best of applicant's information and belief, has not heretofore been provided by a simple, inexpensive, closure apparatus. Applicant's closure is self-sealing: once the shutter has been moved from its closed position (usually by the application of a force less than about 2.0 ounces), it will automatically rotate and plug up the orifice(s) on the depressed area of the lid when the force used to open it has been released.

Figure 1:
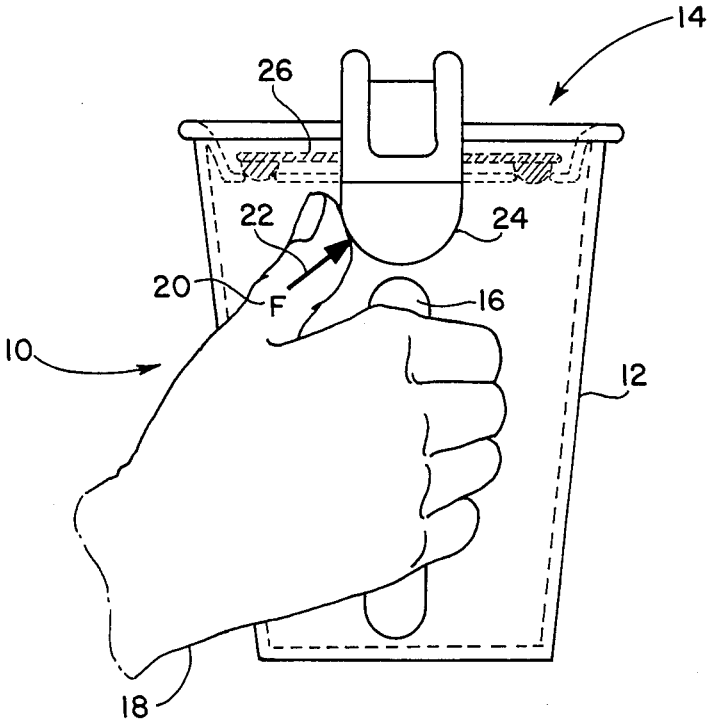
FIGS. 1 and 2 illustrate applicant's closure, attached to a drinking vessel, being opened by thumb pressure.

The self-sealing feature of applicant's closure is illustrated in FIGS. 1, 2, 3, 4, and 5. FIG. 1 is a plan view of a receptacle comprised of applicant's closure. Receptable 10 is comprised of cup 12, closure 14, and handle 16. In FIG. 1, hand 18 is shown gripping handle 16. Thumb 20 exerts a force in the direction of arrow 22 on thumb lever 24 of shutter 26 of closure 14. In general, the force required to move the shutter 26 from the closed position is less than about 2.0 ounces.

Figure 2:
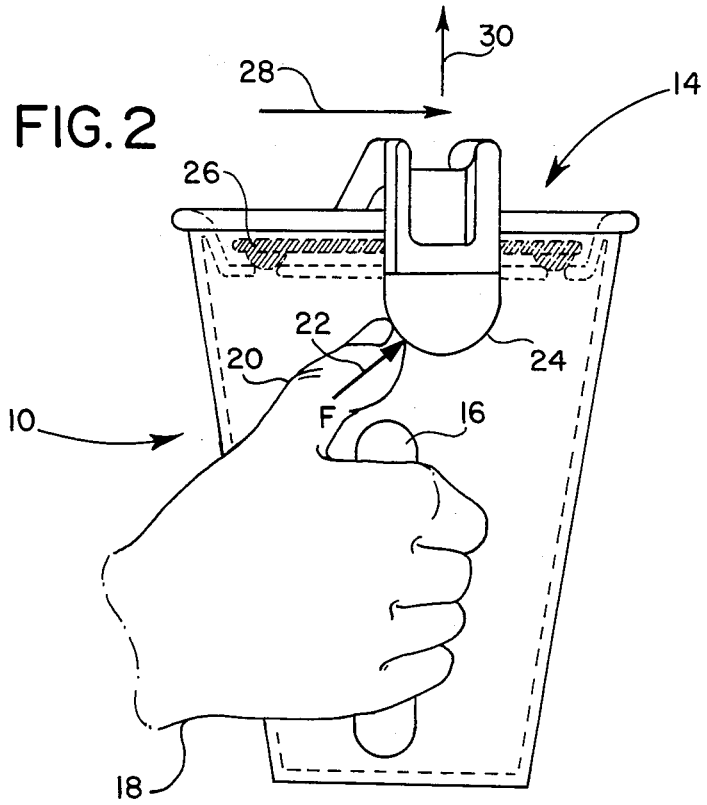

FIG. 2 is a plan view of the receptacle with the shutter 26 having been moved from its closed position (in which no fluid can flow from the receptacle 10) to an open position. The direction of movement of closure 26 caused by the force of thumb 20 is shown by arrow 28. The force 22 exerted by thumb 22 will create movement of the shutter in the directions shown by arrows 28 and 30.

Figure 3:
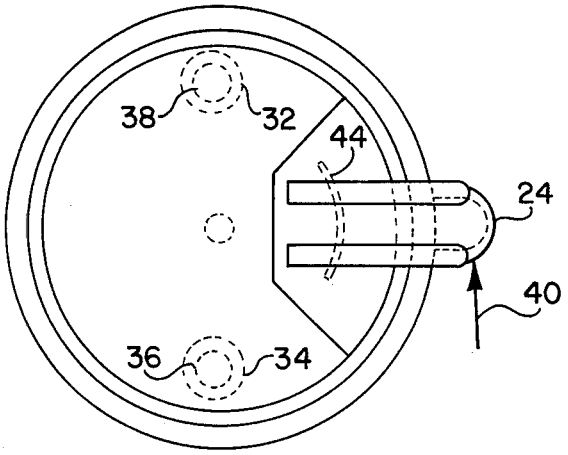
FIGS. 3, 4, and 5 are top views of applicant's closure in the closed position, the open position, and the partially open position, respectively.

FIG. 3 is a top view of the receptacle of FIG. 1, showing the shutter in its closed position. Dimples 32 and 34 extend into (and prevent fluid from passing through) orifices 36 and 38. In order to move the shutter from its closed position, force may be applied in the direction shown by arrow 40.

Figure 4:
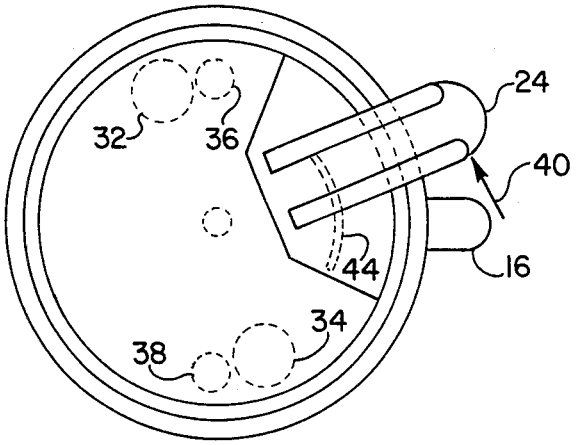

FIG. 4 is a top view of the receptacle of FIG. 1, showing the shutter in its open position. In this position, dimples 32 and 34 do not seal orifices 36 and 38, and fluid may be withdrawn from said orifices from the receptacle 10 through the closure device. The shutter may be maintained in this open position only be the continued application of force in the direction of arrow 40; once the force is removed, the shutter will return to its closed position.

Figure 5:
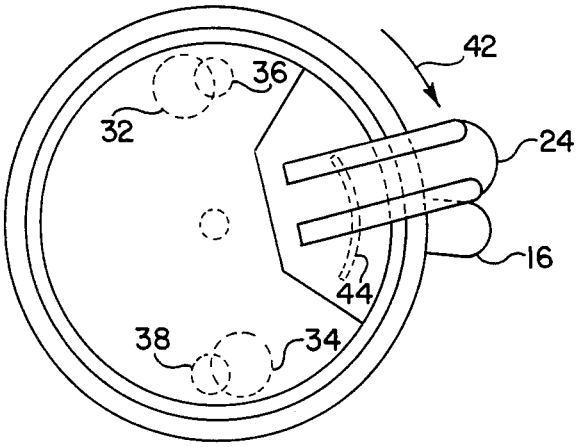

FIG. 5 is a top view of the receptacle of FIG. 1, showing the shutter in the process of returning from its open position of FIG. 4 to its closed position of FIG. 3. The force indicated by arrow 40 has been removed, and the shutter rotates in the direction shown by arrow 42 back towards the position of FIG. 3.

The term "self-sealing," as used in this specification, refers to a closure device which (1) is normally in a closed position, in which it prevents the passage of fluid through it, (2) can be moved to an open position (in which allows the passage of fluid through it) by the application of an external force, (3) will spontaneously return to the closed position once the external force is removed, and (4) requires no more than about 2.8 ounces of force applied along the perimeter of the shutter within a plane perpendicular to the central axis of the shutter to move the shutter from its normally closed position to its open position. Referring to FIG. 2, The force represented by arrow 22 (which normally does not exceed about 4.0 ounces) will have a vertical component (represented by arrow 30) and a horizontal component (represented by arrow 28), neither of which will normally exceed about 2.8 ounces. The force represented by arrow 28 is the force referred to in (4) above. In one preferred embodiment, it is no more than about 1.4 ounces, and force 22 does not exceed about 2.0 ounces.

Figure 6:
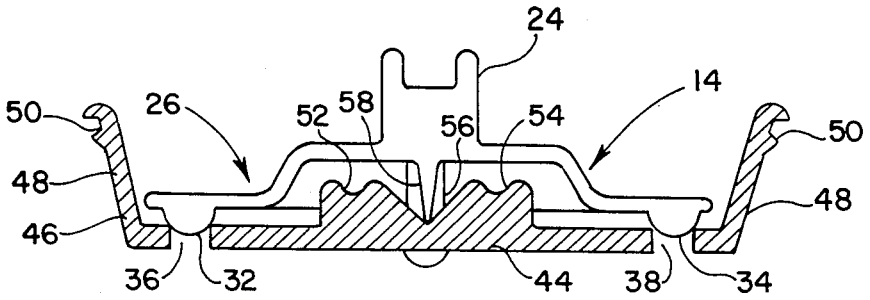
FIGS. 6, 7, and 8 are partial cross-sectional views of applicant's closure in the closed position, the open position, and the locked-open position, respectively.
Figure 7:
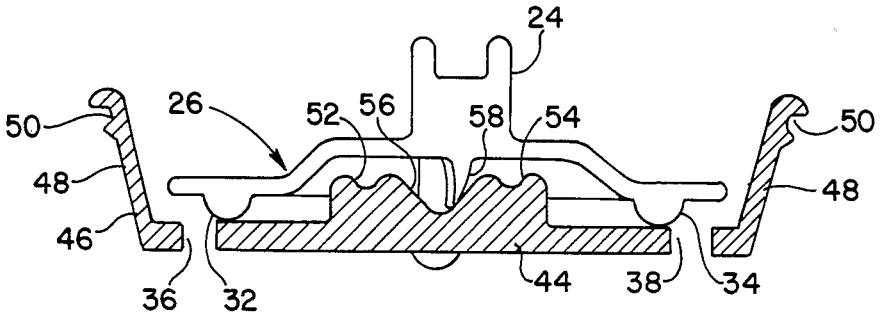
Figure 8:
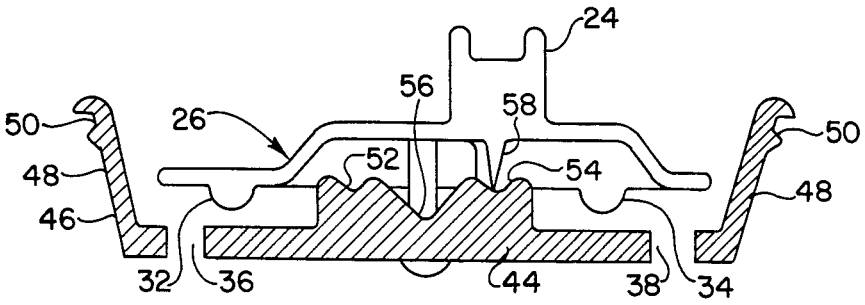

In one preferred embodiment, illustrated in FIGS. 6, 7, and 8, residual forces due to deformations in closure 14 and the detent lever cause the shutter 26 to rotate back to its original position when the thumb force is removed, causing dimples to make intimate contact along the edges of orifices 36 and 38, thereby providing a tight seal.

As is illustrated in FIGS. 3, 4, and 5, shutter 26 rides on ramp 44. The configurations of the ramp 44 and shutter 26 are such that the shutter tends to return to its closed position when the thumb force is removed.

FIGS. 6, 7, and 8 are views of closure assembly 14. In FIG. 6, the shutter assembly is closed. In FIG. 7, because of the application of force, the shutter assembly is open. In FIG. 8, because of the application of even more force, the shutter assembly is locked in the open position.

Referring to FIG. 6, closure assembly 14 is comprised of shutter 26 and lid 46. Lid 46 is comprised of at least one orifice; in the preferred embodiment shown in FIGS. 6, 7, and 8, lid 46 is comprised of at least two orifices, such as orifices 36 and 38. Lid 46 is also comprised of a means for operatively fastening it to a receptacle; in the preferred embodiment illustrated in FIGS. 6, 7, and 8, said means comprise shoulder 48 containing shoulder seal 50; frictional contact between shoulder 48 and the cup to be sealed insures a spill-proof closure. Lid 46 is also preferably comprised of ramp 44.

As is shown in FIGS. 3, 4, and 5, ramp 44 appears only on a minor portion of the surface of lid 46. Referring again to FIGS. 6, 7, and 8, ramp 44 is preferably comprised of open detents 52 and 54 and home detent 56.

Shutter 26 is comprised of dimples 32 and 34, detent lever 58, and thumb lever 24. Force exerted on thumb lever 24 will cause shutter 26 to move home detent 56 and, if sufficient force is applied, to open detent 52 or 54.

It is preferred that the closure device of this invention be comprised of a polymeric material. In a more preferred embodiment, the closure device of this invention consists essentially of a polymeric material. By way of illustration and not limitation, some of the polymeric materials which can be used include, e.g., polyesters, linear polyamides, polyurethanes, and the like. Polymeric materials which may be used in the invention are described in, e.g., B. Golding's "Polymers and Resins," (D. Van Nostrand Company, Inc., Princeton, N.J., 1959), the disclosure of which is hereby incorporated by reference into this specification.

One of the preferred classes of materials which can be used in the closure of this invention are the polyolefin resins. These resins are well known to those skilled in the art and are described in, e.g., pages 568–569 of Volume 10 of the "McGraw-Hill Encyclopedia of Science and Technology," (McGraw-Hill Book Company, New York, 1977), the disclosure of which is hereby incorporated by reference into this specification. The preferred polyolefin resins are polyethylene resins, and the most preferred polyethylene resins are selected from the group consisting of high-density polyethylene, ultra-high-density polyethylene, and mixtures therof.

Another of the preferred classes of materials which can be used ion the closure of this invention are the polyacrylonitrile resins. These resins are known to those in the art and are described in, e.g., pages 534–535 of said Volume 10 of the "McGraw-Hill Encyclopedia of Science and Technology," supra, the disclosure of which is hereby incorporated by reference into this specification. The preferred polyacrylonitrile resins are acrylonitrile-butadiene-styrene(ABS) resins.

Another of the preferred classes of materials which can be used in the closure of this invention are the organic polycarbonates. These polymers are described on pages 289–290 of the aforementioned Golding book, the disclosure of which is hereby incorporated by reference into this case.

The closure 14 of this invention is comprised of lid 26 and shutter 46. Although the lid and shutter can be made from different materials, it is preferred that they be made from the same polymeric material; and it is most preferred that they be made from high-density polyethylene and ultra-high density polyethylene. In one of the more preferred embodiments, both lid 26 and shutter 46 consist essentially of high-density polyethylene with a Young's Modulus of at least 2,000,000 pounds per square inch and a Poisson's ratio of from about 0.40 to about 0.49. Those skilled in the art are familiar with the terms "Young's Modulus" and "Poison÷s ratio." These terms are defined, e.g., on pages 213–214 (for Young's Modulus) and 221–222 (Poison's ratio) of R. D. Snyder's and E. F. Byar's "Engineering Mechanics: Statics and Strength of Materials," (McGraw-Hill Book Company, New York, 1973), the disclosure of which is hereby incorporated by reference into this specification.

In the remainder of this specification, for the purposes of illustration, a closure device whose lid and shutter consist essentially of high density polyethylene with a Young's modulus of at least 2,000,000 p.s.i. and a Poison's ratio of from about 0.40 to about 0.49 will be described, it being understood that closure devices made from other materials are also within the scope of this invention.

Figure 9:
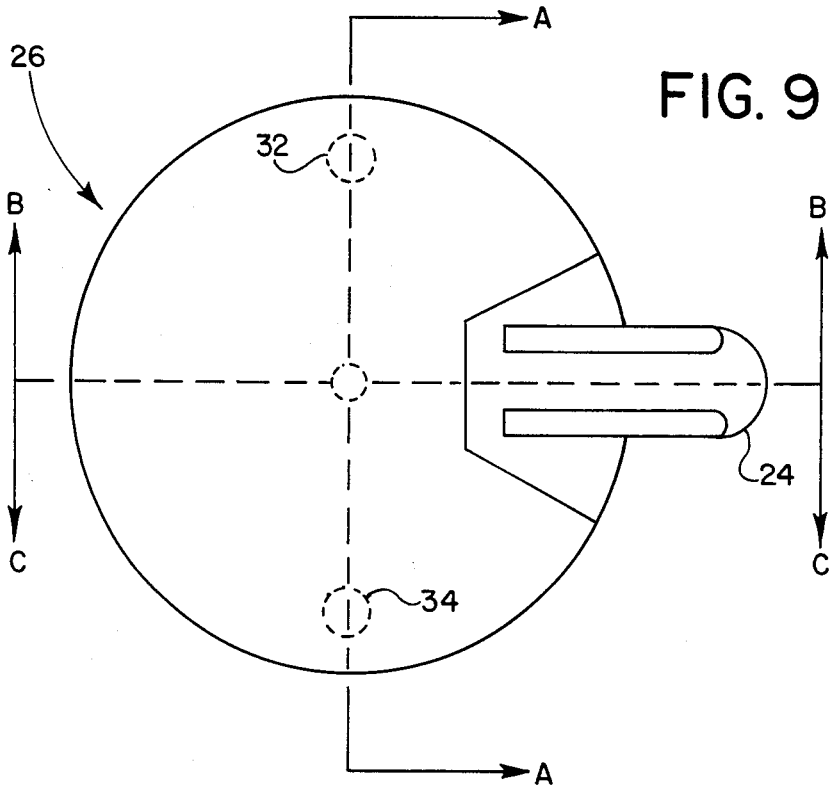
FIG. 9 illustrates how to section samples of applicant's closure in order to determine whether its physical properties are within specification.

Referring now to FiG. 9, a cross-sectional view of the top of shutter 26 is presented. As indicated before, shutter 26 is comprised of thumb lever 24 and dimples 32 and 34.

Sections A—A, B—B, and C—C are each taken by longitudinally cutting through samples of shutter 26 in order to obtain sections A—A, B—B, and C—C of said shutter. Once these sections have been taken, analysis of the physical properties and the relative physical properties of each of these shutters can be done.

It is preferred that sections A—A, B—B, and C—C have certain relative stiffness'. The stiffness of each of these sections can be determined in accordance with the following formula:

$$K_{eff} = \frac{3EI_{eff}}{l^3_{eff}(1 - \nu^2)}$$

wherein: $K_{eff}$ is the effective stiffness of the section, E is the Young's modulus of the material, $\nu$ is the Poisson's ratio of the material, $I_{eff}$ is the effective moment of inertia of the section, and l is the length from the center of the shutter to the center of the dimples, or the center of the ramp.

As is well known to those skilled in the art, the effective moment of inertia of the sections A—A, B—B, and C—C can readily be determined with finite element analysis using a computer program such as, e.g., NASTRAN.

It is preferred that the effective stiffness of section A—A be at least 2.8 times as great as the effective stiffness of either section B—B or section C—C. In a more preferred embodiment, the effective stiffness of A—A is at least 4.5 times as great as the effective stiffness of either section B—B or section C—C. In an even more preferred embodiment, the effective stiffness of A—A is at least 6.0 times as great as the effective stiffness of either section B—B or C—C.

It is preferred that the Young's Modulus of both the lid and the shutter portions of the closure be at least about 500,000 pounds per square inch and that the ratio of moduli for the closure lid/closure shutter be from about 1.0 to about 18.0. It is more preferred that the Young's modulus of both the lid and shutter portions be at least about 2,000,000 pounds per square inch. In an even more preferred embodiment, the ratio of the Young's moduli for the closure lid/closure shutter is from about 1.0 to about 4.5. In the most preferred embodiment, the ratio of the Young's moduli for the closure lid/closure shutter is about 1.0.

It is preferred that coefficient of friction between mating surfaces (the shutter and the lid) used in the preferred embodiment of the closure of this invention is less than about 0.7. In a more preferred embodiment, said coefficient of friction is less than about 0.40. In an even more preferred embodiment, said coefficient of friction is less than about 0.3.

Figure 10:
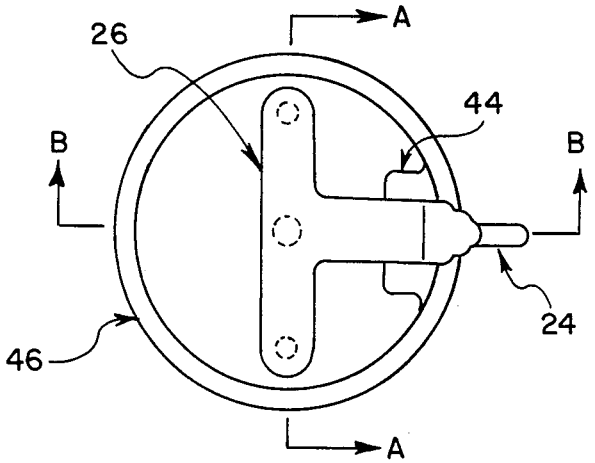
FIG. 10 is a top view of one preferred embodiment of applicant's closure.

Referring now to FIG. 10, a top view of one of the preferred embodiments of applicant's closure is shown. In this preferred embodiment, lid 46 has a circular cross-section. Shutter 26 is rotatably connected to lid 26. In the position in which shutter 46 is shown in FIG. 10, the shutter is in the closed position and will remain in the closed position until force is applied to thumb lever 24 in order to cause shutter 26 to move from the home detent position 56 (not shown) of shutter 26 towards either open detent 52 (not shown) or open detent 54 (not shown) of ramp 44.

Figure 11:
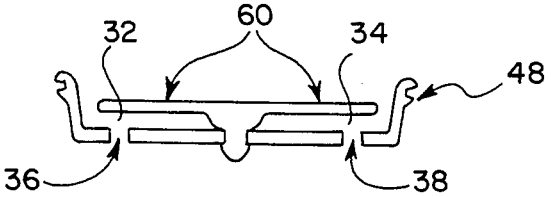
FIG. 11 is a cross-sectional view taken along lines A—A of FIG. 10.

FIG. 11 is a cross-sectional view of the closure of FIG. 10, taken along lines A—A. As is shown in this figure, dimples 32 and 34 extend into orifices 36 and 38, preventing fluid from passing through these orifices. Sections 60 of shutter 26 are closure flexures. Because of the forces on the shutter due to the shutter being in its closed position on the ramp, dimples 32 and 34 securely seal orifices 36 and 38.

FIG. 12 is a cross-sectional view of the closure of FIG. 10, taken along lines B—B.

FIG. 13 is a partial cross-section illustrating the interaction of the shutter 26 and the ramp 44 is the preferred embodiment illustrated in FIGS. 10, 11, and 12. In FIG. 13, shutter 26 is in the closed position. Detent lever 58 is in the home detent 56 position.

As is shown in FIG. 14, force is being applied on thumb lever 24. With the application of force, shutter 26 starts moving in two directions. Referring to FIG. 2, there are force vectors in directions 28 and 30; and there is some displacement in directions 28 and 30.

Referring to FIG. 15, detent lever 58 is now between home detent 56 and open detent 54. In this position, it is in a condition of unstable equilibrium; furthermore, as is indicated in FIG. 7, it also may be slightly deformed. In this position, as soon as the force on thumb lever 24 is released, detent lever will tend to return to home detent 56.

Referring again to FIG. 15, it should be noted that, in the most preferred embodiment, the angle formed between the bottom surface 61 of ramp 44 and an imaginary line drawn by extending the wall 63 of home detent 56 until it intersects bottom surface 61 is from about 30 to about 70 degrees and, preferably, from about 40 to about 60 degrees. In a more preferred embodiment, it is from about 45 to about 55 degrees and, even more preferably, from about 49 to about 53 degrees.

FIG. 16 illustrates what occurs when sufficient force is exerted on detent lever 58 to force it into either open detent 52 or open detent 54. In this position, which is also illustrated in FIG. 8, shutter 26 is locked in the open position and will remain there until sufficient thumb force is exerted to return it to the closed position.

As will be readily apparent to those skilled in the art, applicant's closure device can be utilized with many different sizes, shapes, and types of drinking vessels including, but not limited to, disposable drinking receptacles often utilized by fast food restaurants, full-open cans (in which case, the means for attaching the closure assembly to the can will be modified from that shown in the drawings), dispensers for powders (such as, e.g., spices), disposable paper cups, disposable plastic cups, coffee mugs, tumblers, etc. The gist of applicant's invention does not reside in the size, shape, or type of vessel to which it is attached, but it resides in its self-sealing closure action. Those skilled in the art will readily recognize that the specific apparatus illustrated in the drawings can be easily modified to fit on many types of receptacles by means well known to those in the art.

Although this invention has been illustrated with only a few specific embodiments, it will be recognized that it is applicable to many other embodiments. These other embodiments are within the scope and spirit of this invention.

What is claimed is:

1. A self-sealing closure for a drinking vessel with a receptacle, said closure comprising (a) a lid having a depressed area and at least one orifice within the depressed area; (b) a shutter matching said orifice; (c)

means for resiliently holding the shutter against said orifice; and (d) means rotating within a plane perpendicular to the central axis of said receptacle and lid for pushing the shutter away from said orifice in a direction substantially orthogonal to the plane of said orifice, wherein:

(e) said shutter is normally in a closed position in which the passage of fluid through it is prevented;

(f) said shutter can be moved from its closed position to an open position by the application of an external force, which need not exceed about 2.8 ounces, applied along the perimeter of the shutter within a plane perpendicular to the central axis of the shutter; and (g) when said external force ceases to be applied to the shutter, the shutter spontaneously returns to its closed position.

2. The self-sealing closure as recited in claim 1, wherein said closure consists essentially of polymeric material.

3. The self-sealing closure as recited in claim 2, wherein said polymeric material is selected from the group consisting of polyesters, linear polyamides, polyurethanes, polyolefin resins, polyacrylonitrile resin, organic polycarbonates, and mixtures thereof.

4. The self-sealing closure as recited in claim 2, wherein said polymeric material is an acrylonitrile-butadiene-styrene resin.

5. The self-sealing closure as recited in claim 2, wherein said polymeric material is an organic polycarbonate.

6. The self-sealing closure as recited in claim 2, wherein said polymeric material is a polyolefin resin.

7. The self-sealing closure as recited in claim 6, wherein said polymeric material is a polyethylene resin.

8. The self-sealing closure as recited in claim 7, wherein the coefficient of friction between mating surfaces of said shutter and said lid is less than about 7.

9. The self-sealing closure as recited in claim 8, wherein said polymeric material is selected from the group consisting of high-density polyethylene, ultra-high density polyethylene, and mixtures thereof.

10. The self-sealing closure as recited in claim 9, wherein the coefficient of friction between mating surfaces of said shutter and said lid is less than about 0.4.

11. The self-sealing closure as recited in claim 10, wherein said polymeric material has a Young's modulus of at least 500,000 pounds per square inch.

12. The self-sealing closure as recited in claim 11, wherein both said lid and said shutter have a Poisson's ratio of from about 0.40 to about 0.49.

13. The self-sealing closure as recited in claim 12, wherein said polymeric material has a Young's modulus of at least 2,000,000 pounds per square inch.

14. The self-sealing closure as recited in claim 13, wherein the coefficient of friction between mating surfaces of said shutter and said lid is less than about 0.3.

15. The self-sealing closure as recited in claim 14, wherein the ratio of Young's moduli for said lid and said shutter is from about 1.0 to about 4.5.

16. The self-sealing closure as recited in claim 15, wherein both said lid and said shutter consist essentially of the same polymeric material.

* * * * *